US008985236B2

(12) United States Patent
Wierer et al.

(10) Patent No.: US 8,985,236 B2
(45) Date of Patent: Mar. 24, 2015

(54) HANDHELD POWER TOOL

(75) Inventors: Michael Wierer, Bludenz (AT); Adrian Scherrer, Walzenhausen (CH); Fabian Martin, Gossau (CH); Josef Althaus, Fischen (DE)

(73) Assignee: Hilti Aktiengesellschaft, Schaan (LI)

( * ) Notice: Subject to any disclaimer, the term of this patent is extended or adjusted under 35 U.S.C. 154(b) by 358 days.

(21) Appl. No.: 13/222,724

(22) Filed: Aug. 31, 2011

(65) Prior Publication Data

US 2012/0055689 A1 Mar. 8, 2012

(30) Foreign Application Priority Data

Sep. 2, 2010 (DE) ..... 10 2010 040 173

(51) Int. Cl.
*B25D 17/24* (2006.01)
*B25D 17/04* (2006.01)

(52) U.S. Cl.
CPC ..... *B25D 17/043* (2013.01); *B25D 17/24* (2013.01); *B25D 2211/003* (2013.01); *B25D 2211/068* (2013.01); *B25D 2217/0092* (2013.01)
USPC ..... 173/162.1; 173/162.2

(58) Field of Classification Search
USPC ..... 173/162.1, 162.2, 210, 211, 200
See application file for complete search history.

(56) References Cited

U.S. PATENT DOCUMENTS

| | | | | |
|---|---|---|---|---|
| 2006/0289185 | A1* | 12/2006 | Hahn | 173/210 |
| 2008/0022817 | A1* | 1/2008 | Fischer et al. | 81/489 |
| 2008/0047724 | A1* | 2/2008 | Fischer et al. | 173/162.2 |
| 2008/0202785 | A1* | 8/2008 | Fischer et al. | 173/162.2 |
| 2009/0151967 | A1* | 6/2009 | Haas et al. | 173/162.1 |
| 2009/0218114 | A1 | 9/2009 | Ohlendorf et al. | |
| 2010/0018735 | A1* | 1/2010 | Aoki | 173/210 |
| 2010/0206594 | A1* | 8/2010 | Meixner | 173/162.2 |
| 2010/0307783 | A1* | 12/2010 | Baumann et al. | 173/162.2 |

FOREIGN PATENT DOCUMENTS

| | | | |
|---|---|---|---|
| DE | 815 179 | B | 8/1951 |
| DE | 10 2004 021 905 | B3 | 11/2005 |
| DE | 10 2007 055 843 | A1 | 6/2009 |
| EP | 1 415 768 | A1 | 5/2004 |
| EP | 2 018 939 | A2 | 1/2009 |
| EP | 2 143 530 | A1 | 1/2010 |
| EP | 2 159 008 | A2 | 3/2010 |

OTHER PUBLICATIONS

European Search Report, dated Nov. 14, 2011, 8 pages.

* cited by examiner

*Primary Examiner* — Nathaniel Chukwurah
(74) *Attorney, Agent, or Firm* — Crowell & Moring LLP

(57) ABSTRACT

A handheld power tool is disclosed. The handheld power tool has a drive oscillating along a working axis and a vibration damper. The vibration damper has a mass element suspended in a spring mechanism. The spring mechanism acts with a first spring stiffness and acts with a second spring stiffness. The first spring stiffness is different from the second spring stiffness.

20 Claims, 2 Drawing Sheets

HANDHELD POWER TOOL

This application claims the priority of German Patent Document No. 10 2010 040 173.0, filed Sep. 2, 2010, the disclosure of which is expressly incorporated by reference herein.

BACKGROUND AND SUMMARY OF THE INVENTION

The present invention relates to a handheld power tool.

The inventive handheld power tool has a drive oscillating along a working axis and has a vibration damper. The vibration damper has a mass element suspended in a spring mechanism. The spring mechanism acts in a first direction parallel to the working axis with a first spring stiffness and it acts with a second spring stiffness in a second direction opposite the first direction. The first spring stiffness is different from the second spring stiffness.

The handheld power tool, for example, a handheld power tool having a pneumatic striking mechanism, exerts a return blow periodically on the user. The amplitude thereof may be diminished by the vibration damper, but a vibration damper having an asymmetrical design can produce a greater damping effect with the handheld power tool. The spring stiffness may have a discontinuity or a very drastic change relative to the basic position. The discontinuity leads to a highly non-harmonious movement of the mass element and non-harmonious forces, which may be more suitable for damping the machine housing.

According to one embodiment, the first spring stiffness amounts to between five and ten times the second spring stiffness. The ratio of the spring stiffness values may be used to adjust the damping of the vibration damper to the rebound behavior of the handheld power tool. The greater the ratio, the shorter and greater is the acceleration of the mass element by the stiffer side.

According to one embodiment, the mass element in the basic position is in contact with the spring. In the basic position the mass element may be arranged between two prestressed springs. According to one embodiment, the two prestressed springs are fixedly connected to the mass element. Because of the fixed connection, this results in low losses in the springs due to plastic deformation or due to friction.

According to one embodiment, the mass element is attached to a bending spring which is arranged at an inclination to the working direction. The bending spring is relaxed when the mass element is in the basic position.

The following description illustrates the invention on the basis of exemplary embodiments and figures.

DETAILED DESCRIPTION OF THE DRAWINGS

Figure 1:
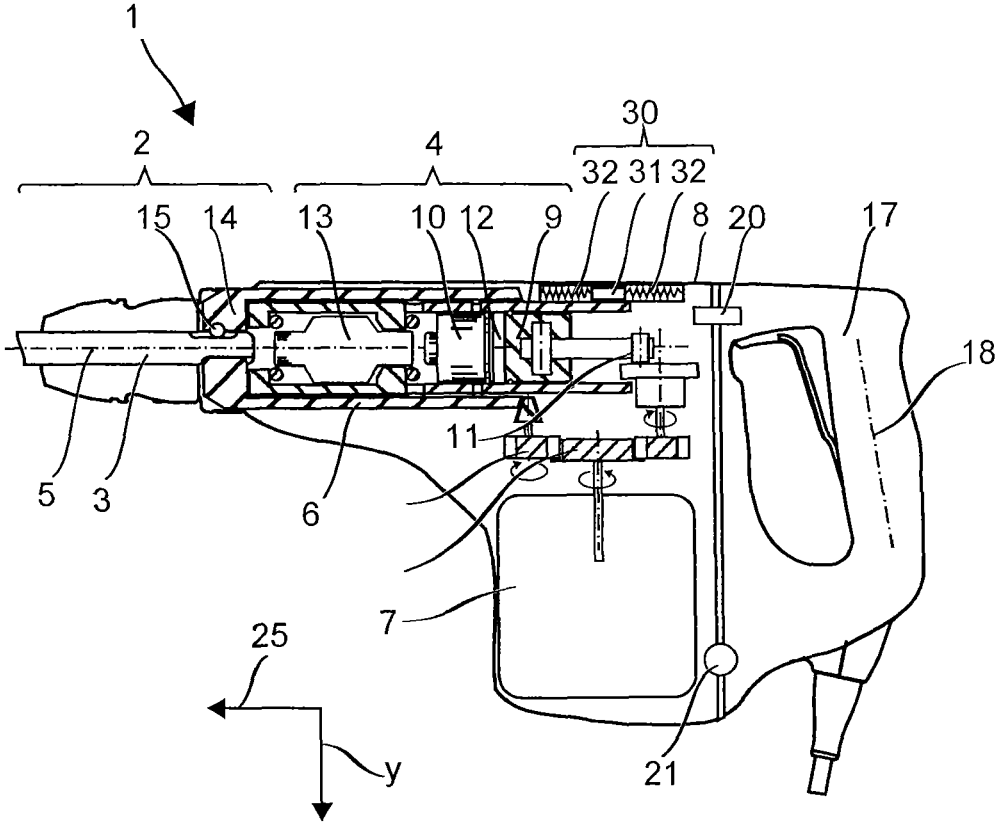
FIG. 1 illustrates an embodiment of a handheld power tool in accordance with the principles of the present invention.

The same elements or those having the same function are indicated by the same reference numerals in the figures, unless otherwise indicated.

FIG. 1 shows as one embodiment a drill hammer 1. The drill hammer 1 has a tool receptacle 2 to receive a boring tool 3. A striking mechanism 4 of the drill hammer 1 periodically strikes the boring tool 3 inserted into the tool receptacle 2 along a working axis 5 and thereby drives it into the substrate. Meanwhile, a rotary drive 6 can rotate the boring tool 3 around the working axis 5.

The striking mechanism 4 and the rotary drive 6 may be driven by a shared motor 7, for example, an electric motor. A machine housing 8 surrounds the striking mechanism 4, the rotary drive 6 and the motor 7, which is optionally shared.

The striking mechanism 4 is a pneumatic striking mechanism, for example. An exciter 9 and a beater 10 are movably guided in the pneumatic striking mechanism 4 along the working axis 5. The exciter 9 is coupled to the motor 7 via an eccentric cam 11 or a wobbling finger and forced to execute a periodic linear movement. A pneumatic spring formed by a pneumatic chamber 12 between the exciter 9 and the beater 10 couples a movement of the beater 10 to the movement of the exciter 9. The beater 10 may directly strike a rear end of the boring tool 3 or may transmit a portion of its pulse to the boring tool 3 indirectly via an essentially stationary intermediate beater 13.

The tool receptacle 2 has a sleeve 14, for example, into which the boring tool 3 can be inserted. One or more locking elements 15, e.g., spheres, protrude into the sleeve 14 and engage in longitudinally closed grooves on the boring tool 3. The boring tool 3 may slide along the working axis 5 according to the length of its grooves in the tool receptacle 2. The rotary drive 6 rotates the sleeve 14 around the working axis 5.

The user can guide the drilling hammer 1 by hand by a handle 17. The handle 17 is attached to a side of the machine housing 8 facing away from the tool receptacle 2. A longitudinal axis 18 of the handle 17 runs obliquely or at a right angle to the working axis 5. The drill hammer 1 is in mirror symmetry with a plane of symmetry (corresponding to the plane of the drawing), for example, which is spanned by the working axis 5 and a longitudinal axis 18 of the handle 17. An axis perpendicular to the plane of symmetry is hereinafter referred to as the x axis. The y axis is perpendicular to the x axis and to the working axis 5.

The striking mechanism 4, which operates periodically, induces vibrations or oscillations in the machine housing 8. Spring mechanisms 20, 21 of the handle 17 on the machine housing 8 partially suppress a transmission of the vibrations to the handle 17 to reduce the physiological burden on the user.

A further reduction in the burden for the user is achieved by a vibration damper 30 which is arranged in the machine housing 8. The vibration damper 30 has a mass element 31, which is connected by a spring mechanism 32 to the machine housing 8. The vibrating machine housing 8 excites the mass element 31 of the vibration damper 30 to also vibrate. The system comprising the mass element 31 and the spring mechanism 32 is coordinated with a natural frequency, which is somewhat greater than the excitation frequency due to the machine housing 8, i.e., the rate of repetition of the striking mechanism 4. The vibration damper 30 cannot entirely follow the vibration of the machine housing 8 and is stabilized in phase opposition. The deviation in the natural frequency from the excitation frequency is preferably low, for example, less than 10%, which achieves an efficient energy transfer between the machine housing 8 and the vibration damper 30.

Figure 2:
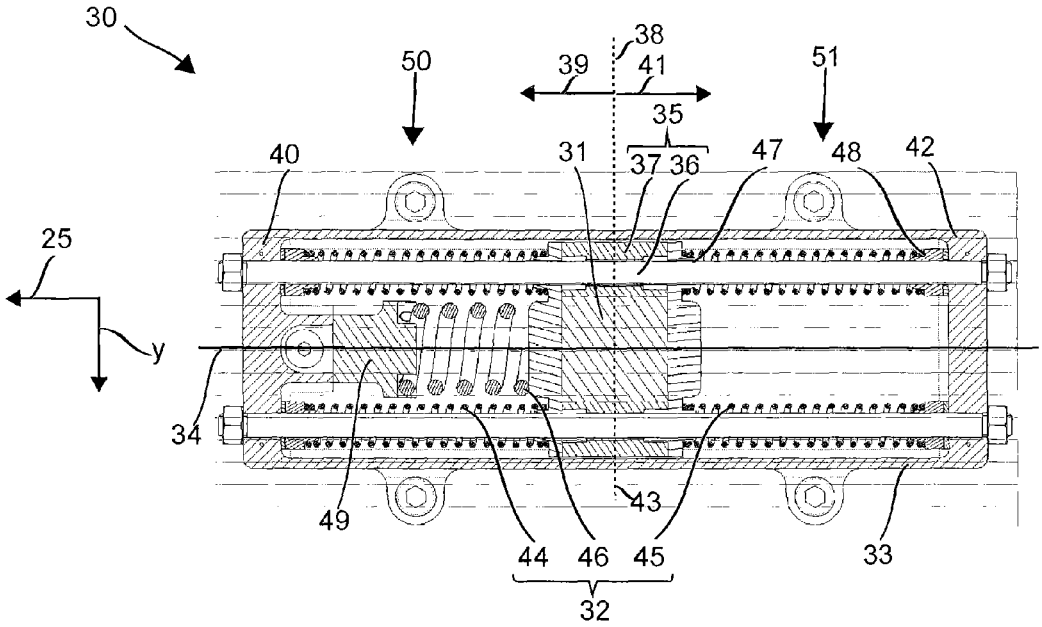
FIG. 2 illustrates a vibration damper of the handheld power tool of FIG. 1 in accordance with the principles of the present invention.

FIG. 2 shows in detail an embodiment of the vibration damper 30. The vibration damper 30 has a housing 33 in which the mass element 31 is mounted along an axis of vibration 34. An exemplary bearing 35 includes round rods 36 which are fastened parallel to the axis of vibration 34 from the housing 33. The mass element 31 has longitudinal bores 37 or longitudinal grooves running through the round rods 36. The bearing 35 is preferably of low friction. Other embodiments of linear bearings, e.g., with rolling bodies, may also be used.

The mass element 31 may be shifted from a basic position 38 (shown in FIG. 2) along the axis of vibration 34 into a first direction 39 to a first end 40 of the vibration damper 30 and along the axis of vibration 34 into an opposite second direction 41 to a second end 42 of the vibration damper 30. The spring mechanism 32 produces a restoring force on the mass element 31 as soon as it is deflected out of the basic position 38. The spring mechanism 32 is designed to be asymmetrical with the basic position 38. In the example shown here, the basic position 38 coincides with a geometric center of the spring mechanism 32 or of the vibration damper 30 and thus the spring mechanism 32 is asymmetrical with a plane 43 which is perpendicular to the working axis 5 and runs through the geometric center of the spring mechanism 32. A greater restoring force acts on the mass element 31 when it is deflected out of the basic position 38 by a stroke in the first direction 39 than when the mass element 31 is deflected out of the basic position 38 by an identical stroke in the opposite second direction 41.

The exemplary spring mechanism 32 has first springs 44, second springs 45 and a third spring 46. The first springs 44 are attached to the first end 40 of the housing 33 and to the mass element 31, for example, by clamping elements 47, 48 (only labeled with respect to second springs 45). The first springs 44 return the mass element 31 in the second direction 41 when it is deflected out of the basic position 38 in the first direction. The second springs 45 are attached to the second end 42 of the housing 33 and to the mass element 31. The mass element 31 is returned in the first direction by the second springs 45 when it is deflected out of the basic position 38 in the second direction. The first springs 44 and the second springs 45 may be designed identically, for example, with the same length and the same spring stiffness. The first springs 44 and the second springs 45 may be prestressed when the mass element 31 is in the basic position 38. In addition, the first springs 44 and the second springs 45 may also be prestressed when the mass element 31 is maximally deflected into the one direction or the other 39, 41.

The third spring 46 is arranged on only one side of the mass element 31, for example, between the first end 40 of the housing 33 and the mass element 31. The third spring 46 is fixedly connected to the housing 33 but is only in contact with the mass element 31 in its basic position 38. When the mass element 31 is moved from the basic position 38 into the first direction 39, the third spring 46 is compressed. With a movement in the second direction 41, the third spring 46 is released from the mass element 31 as soon as it crosses over the basic position 38. Alternatively the third spring 46 is fixedly connected to the mass element 31 and is released from a seat 49 on the housing 33. The length of the third spring 46 is equal to the distance of the mass element 31 to the seat 49. The third spring 46 is without prestress when the mass element 31 is in the basic position 38.

The spring stiffness of the spring mechanism 32 on the first side 50 of the mass element 31, i.e., in the first direction 39, may be selected to be five to ten times larger than the spring stiffness of the spring mechanism 32 on the second side 51. In the example shown here with two first springs 44 and a third spring 46 on the first side 50 and two second springs 45 on the second side 50, the third spring 46 may be selected with a stiffness three to eight times greater than that of the same first and second springs 45, 42.

With the drill hammer 1 presented here, the vibration damper 30 is arranged with the first direction 39 pointing at the tool 3, i.e., in the direction of impact 25. When the beater 10 strikes the tool 3 and drives the latter into the substrate, this yields a short recoil of a high amplitude, which is better coupled to the stiffer side of the vibration damper 30. A second rebound, which is weaker but longer-acting at the same time, is obtained when the beater 10 is repelled by the exciter 9 via the air cushion. This softer rebound is better coupled to the softer side of the vibration damper 30.

The springs 44, 45, and 46 are helical springs made of steel, for example. The first springs 44 and the second springs 45 may be arranged coaxially with the round rods 36.

In another embodiment the spring mechanism 32 may be embodied with only one spring on each side 50, 51 of the mass element 31, where the springs 45, 46 have a different spring stiffness. The softer spring 45 is preferably prestressed to the extent that it is in contact with the mass element 31 in any position of the latter. The harder spring 46 is released from the mass element 31 when the latter moves out of the basic position opposite the softer spring 45.

The axis of vibration 34 is inclined parallel to or at an angle of less than 5 degrees to the working axis 5 of the handheld power tool 1.

Figure 3:
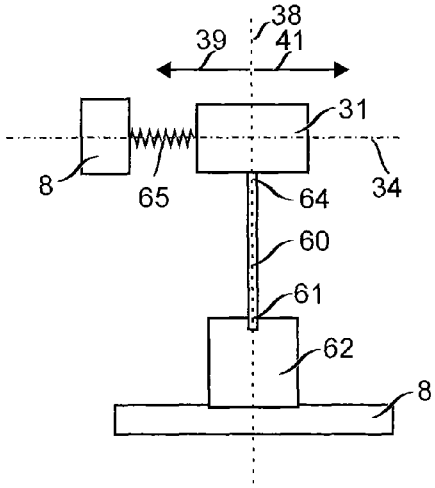
FIGS. 3 and 4 illustrate alternative embodiments of a vibration damper in accordance with the principles of the present invention.
Figure 4:
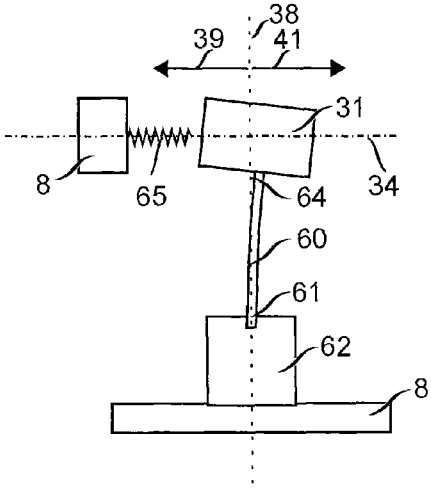

FIGS. 3 and 4 illustrate another embodiment. The spring mechanism 32 has a bending spring 60, e.g., a plate spring which is aligned perpendicular to the axis of vibration 34. The bending spring 60 is attached at one end 61 to a seat 62 in the housing 33 of the vibration damper. On the other end 64 the mass element 31 is attached. The mass element 31 oscillates along the axis of vibration 34, whereupon the bending spring 60 is bent along its longitudinal extent. A basic position 38 of the mass element 31 is obtained with the bending spring 60 relaxed and unbent.

A helical spring 65 is arranged parallel to the axis of vibration 34 on one side of the mass element 31. The helical spring 65 touches the mass element 31 when it is in the basic position. In a deflection of the mass element 31 into the first direction 39 the helical spring 65 is compressed. The restoring forces of the bending spring 60 and the helical spring 65 act on the mass element 31. With a deflection of the mass element 31 in the opposite second direction 41 (FIG. 4) the mass element 31 is released from the helical spring 65. Only the restoring force of the bending spring 60 acts on the mass element 31.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A handheld power tool, comprising:

a drive, wherein the drive is oscillatable along a working axis of the handheld power tool; and a vibration damper, wherein the vibration damper includes:

a housing;

a spring mechanism; and a mass element suspended in the spring mechanism;

wherein the spring mechanism and the suspended mass element are mounted in the housing;

wherein the spring mechanism is actable with a first spring stiffness on the mass element in response to a deflection of the mass element out of a basic position and in a first direction parallel to the working axis;

wherein the spring mechanism is actable with a second spring stiffness on the mass element in response to a deflection out of the basic position and in a second direction, wherein the second direction is opposite from the first direction;

wherein the first spring stiffness is different from the second spring stiffness;

and wherein the spring mechanism and the suspended mass element is coordinated with a natural frequency which is greater by less than 10% to a rate of repetition of a striking mechanism of the handheld power tool.

2. The handheld power tool according to claim 1, wherein the first spring stiffness is between five and ten times greater than the second spring stiffness.

3. The handheld power tool according to claim 1, wherein the mass element is in contact with the spring mechanism in the basic position.

4. The handheld power tool according to claim 1, wherein the spring mechanism includes two prestressed springs and wherein the mass element is arranged between the two prestressed springs in the basic position.

5. The handheld power tool according to claim 4, wherein the two prestressed springs are fixedly connected to the mass element.

6. The handheld power tool according to claim 1, wherein the spring mechanism includes a bending spring which is arranged at an inclination to the working axis and wherein the mass element is attached to the bending spring.

7. The handheld power tool according to claim 6, wherein the bending spring is relaxable when the mass element is in the basic position.

8. The handheld power tool according to claim 1, wherein the vibration damper further includes a bearing disposed within the housing and wherein the mass element is moveable on the bearing.

9. The handheld power tool according to claim 1, wherein the first spring stiffness is greater than the second spring stiffness, wherein the first spring stiffness is disposed on a tool side of the power tool, and wherein the second spring stiffness is disposed on a handle side of the power tool.

10. A handheld power tool, comprising:

a drive, wherein the drive is oscillatable along a working axis of the handheld power tool; and a vibration damper, wherein the vibration damper includes:

a housing;

a spring mechanism with a first spring element and a second spring element; and a mass element disposed between the first spring element and the second spring element;

wherein the spring mechanism and the mass element are mounted in the housing;

wherein the first spring element has a first spring stiffness and the second spring element has a second spring stiffness and wherein the first spring stiffness is different from the second spring stiffness;

and wherein the spring mechanism and the mass element is coordinated with a natural frequency which is greater by less than 10% to a rate of repetition of a striking mechanism of the handheld power tool.

11. The handheld power tool according to claim 10, wherein the first spring element includes a first spring and the second spring element includes a second spring.

12. The handheld power tool according to claim 11, wherein the first spring element further includes a third spring.

13. The handheld power tool according to claim 12, wherein the first spring of the first spring element has the first spring stiffness and wherein the second spring of the second spring element has the second spring stiffness.

14. The handheld power tool according to claim 13, wherein the third spring of the first spring element has a same spring stiffness as the second spring of the second spring element.

15. The handheld power tool according to claim 11, wherein the second spring element is disposed at an angle to the working axis.

16. The handheld power tool according to claim 15, wherein the first spring element is a helical spring and the second spring element is a bending spring.

17. The handheld power tool according to claim 10, wherein the first spring element is releasably contactable with the mass element.

18. The handheld power tool according to claim 10, wherein the first spring element is fixedly connected to the mass element.

19. The handheld power tool according to claim 10, wherein the vibration damper further includes a bearing disposed within the housing and wherein the mass element is moveable on the bearing.

20. The handheld power tool according to claim 10, wherein the first spring stiffness is greater than the second spring stiffness, wherein the first spring element with the first spring stiffness is disposed on a tool side of the power tool, and wherein the second spring element with the second spring stiffness is disposed on a handle side of the power tool.

* * * * *